US007001701B2

(12) United States Patent
Fujii et al.

(10) Patent No.: US 7,001,701 B2
(45) Date of Patent: Feb. 21, 2006

(54) COLOR TONER, ELECTROSTATIC LATENT IMAGE DEVELOPER, IMAGE FORMING METHOD, AND IMAGE PRODUCING DEVICE

(75) Inventors: Takahisa Fujii, Minamiashigara (JP); Yasuo Matsumura, Minamiashigara (JP); Kazuhiko Yanagida, Minamiashigara (JP); Manabu Serizawa, Minamiashigara (JP); Hidekazu Yaguchi, Minamiashigara (JP); Masaki Nakamura, Minamiashigara (JP); Daisuke Ishizuka, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/972,484

(22) Filed: Oct. 26, 2004

(65) Prior Publication Data

US 2005/0058923 A1 Mar. 17, 2005

Related U.S. Application Data

(62) Division of application No. 10/372,246, filed on Feb. 25, 2003, now Pat. No. 6,846,603.

(30) Foreign Application Priority Data

Sep. 20, 2002 (JP) ..... 2002-276100

(51) Int. Cl.
*G03G 9/08* (2006.01)

(52) U.S. Cl. ..... 430/108.4; 430/109.3; 430/109.4; 430/111.4; 430/124

(58) Field of Classification Search ..... 430/108.4, 430/109.3, 109.4, 111.4, 124
See application file for complete search history.

(56) References Cited

U.S. PATENT DOCUMENTS

| | | | |
|---|---|---|---|
| 5,554,471 | A | 9/1996 | Bertrand et al. |
| 5,851,718 | A | 12/1998 | Ohwada et al. |
| 6,040,104 | A | 3/2000 | Nakamura et al. |

*Primary Examiner*—John L Goodrow
(74) *Attorney, Agent, or Firm*—Oliff & Berridge, PLC

(57) ABSTRACT

The present invention discloses a color toner providing highly gloss image and documents with excellent long term storability; an electrostatic latent image developer; and an image forming method. Disclosed is a color toner comprising a binder resin and colorant, wherein the weight average molecular weight of the binder resin is from 6000 to 45000, the toner's glass transition temperature (Tg) is from 40 to 70° C., the loss tangent tan δ of dynamic viscoelasticity is from 0.1 to 2.5 in the temperature of from the toner's glass transition temperature (Tg) to the temperature at which the loss modulus (G") is $1\times10^5$ Pa, and the toner comprises 3 to 20% by mass of an ester derivative of an alicyclic compound having 1 or more carboxyl groups, and an electrostatic latent image developer and an image forming method, which use the color toner.

21 Claims, 1 Drawing Sheet

COLOR TONER, ELECTROSTATIC LATENT IMAGE DEVELOPER, IMAGE FORMING METHOD, AND IMAGE PRODUCING DEVICE

This is a Divisional of application Ser. No. 10/372,246 filed Feb. 25, 2003, now U.S. Pat. No. 6,846,603, which claims the benefit of U.S. Japanese Application No. 2002-276100 filed Sep. 20, 2002. The entire disclosure of the prior applications is hereby incorporated by reference herein in its entirety.

BACKGROUND OF THE INVENTION

1. Field of the Invention

The present invention relates to a color toner for developing electrostatic images used in forming an image by electrophotography, an electrostatic latent image developer, and an image forming method.

2. Description of the Related Art

At present, the method of visualizing image information via an electrostatic image by an electrophotographic method etc. is used in various fields. In the electrophotographic method, an electrostatic image is formed on a photoreceptor in a light exposure step, and the electrostatic latent image is then developed with a toner-containing developer and visualized through transferring and fixing step. The developer used herein includes a two-components developer comprising a toner and a carrier and a one-component developer using a magnetic or non-magnetic toner alone, and the toner is produced usually by a kneading and milling process wherein a thermoplastic resin is melt-kneaded with a pigment, a charge controlling agent, and a releasing agent such as wax, then cooled, pulverized, and classified. Fine inorganic and organic particles for improving fluidity and cleaning properties may be added if necessary to the surfaces of such toner particles.

Copiers by a color electrophotographic method, printers, or combined machines thereof such as facsimiles have been widely distributed in recent years, but gloss suitable for reproduction of color images and transparency for achieving excellent OHP images are hardly realized by a toner containing a releasing agent such as wax, prepared by melt kneading. This is because wax such as polyethylene, polypropylene and paraffin used generally in usual black and white copies is melt-kneaded to permit the domain diameter of the releasing agent to be varied, and when such toner is used, the transparency of OHP images is deteriorated. Accordingly, a large amount of oil is applied onto fixing rolls to facilitate release, but causes stickiness of reproduced images including OHP images and makes writing on the images by a pen difficult, and uneven gloss may often occur.

Further, the method of producing a toner by the conventional kneading and milling process hardly prevents the releasing agent from being exposed to the surface of the toner, so that when the toner is used as a developer, there arise additional problems such as a significant deterioration in fluidity, filming on a developing unit and a photoreceptor, etc.

As a method of essentially solving these problems, there is a proposal on a polymerization process wherein a toner is produced by dispersing an oil phase composed of a monomer as a starting material of resin and a colorant in an aqueous phase and then polymerizing the monomer directly thereby allowing the wax to be included in the toner to control exposure of the wax to the surface.

As another means of enabling intentional regulation of the shape and surface structure of a toner, a method of producing a toner by an emulsion polymerization aggregation method is proposed. This is a production process which comprises preparing a dispersion of fine resin particles generally by emulsion polymerization while separately preparing a dispersion of colorant particles having colorant particles dispersed in a solvent, mixing the dispersions to form aggregated particles having a size corresponding to the particle size of an intended toner, and coalesced the particles by heating to form the toner.

The above-described process for producing a toner not only realizes inclusion of wax but also facilitates formation of a toner of smaller diameter to achieve reproduction of vivid images of higher resolution, and there is demand for further improvements (see Japanese Patent Application Laid-Open (JP-A) Nos. 63-282752 and 6-250439).

SUMMARY OF THE INVENTION

As color copy machines and printers speed up in recent years, use of an image forming device in electrophotography as a printing machine for a small number of copies is expected.

When the image forming device in electrophotography is used as a printing machine, its applicability to various kinds of paper, as compared with office use, is required, and even if highly glossy paper used in pamphlets is used, the absence of gloss between the paper and developed images is required. Further, the long-term storage ability of documents is an essential requirement.

Accordingly, the object of the present invention is to provide a color toner which can give a highly glossy image and give a document excellent in storage ability for a long time, to solve the problem described above.

As a result of extensive study, the inventors found that the problem described above can be solved by a toner comprising a relatively low molecular binder resin having a molecular weight distribution in a defined range and an ester derivative of an alicyclic compound having one or more carboxyl groups, a rosin-modified maleic acid or a styrenemaleic acid, and the invention is thereby completed.

That is, the first aspect of the invention provides a color toner comprising at least a binder resin and a colorant, wherein the weight average molecular weight of the binder resin is in the range of from 6000 to 45000;

the glass transition temperature (Tg) of the toner is in the range of from 40 to 70° C.;

the loss tangent tan δ of dynamic viscoelasticity is in the range of from 0.1 to 2.5 in the temperature range of from the glass transition temperature (Tg) of the toner to the temperature at which the loss modulus (G") is $1\times10^5$ Pa; and the toner contains 3 to 20% by mass of at least one selected from the group consisting of a rosin-modified maleic acid and a styrenemaleic acid.

The second aspect of the invention provides a color toner wherein the molecular weight distribution of the binder resin, represented by Mw/Mn that is the ratio of weight average molecular weight Mw to number average molecular weight Mn, is 3.3 or less.

The third aspect of the invention provides a color toner wherein the softening point of the at least one selected from the group consisting of a rosin-modified maleic acid and a styrenemaleic acid is 135 to 160° C.

The fourth aspect of the invention provides a color toner further comprising a releasing agent.

The fifth aspect of the invention provides an electrostatic latent image developer comprising the toner and a carrier having a resin coating layer.

The sixth aspect of the invention provides an image forming method comprising the steps of: forming an electrostatic latent image on an image holding member in accordance with image information; visualizing the electrostatic latent image as a toner image using a developer; transferring the toner image onto a transfer material; and fixing the transfer material, to which the toner image is transferred, wherein the developer includes the toner of the invention.

The seventh aspect of the invention provides an image forming device comprising a device for forming an electrostatic latent image on an image holding member in accordance with image information; a device for visualizing the electrostatic latent image as a toner image using a developer; a device for transferring the toner image onto a transfer material; and a device for fixing the transfer material having the toner image transferred thereon, wherein the developer includes the toner of the invention.

Generally, when a toner containing a relatively low molecular binder resin is used to form a fixed image, a highly glossy fixed image can be obtained even when a highly glossy paper is used, and this tendency is significant when the binder resin has a narrow distribution of molecular weights.

On the other hand, the binder resin is brittle, and the fixed image is brittle upon application of bending strength, and when a document with the fixed image thereon is stored for a long time, the fixed image sticks to an opposing fixed image or to an opposing paper, or one or both of the fixed images are broken to cause an offset phenomenon.

Further, if the glass transition temperature of the toner is increased to improve its storage ability, the temperature range in which the toner can be fixed is shifted upward to cause a problem such as high energy consumption.

In the invention, the binder resin can be endowed with elasticity by adding a suitable amount of an ester derivative of an alicyclic compound having one or more carboxyl groups, a rosin-modified maleic acid or a styrenemaleic acid to a color toner containing a relatively low molecular weight binder resin having a low glass transition temperature, and both high glossiness and improvement of strength of fixed images can be achieved by defining tan δ in the range where the viscosity is changed.

DESCRIPTION OF THE PREFERRED EMBODIMENTS

Figure 1:
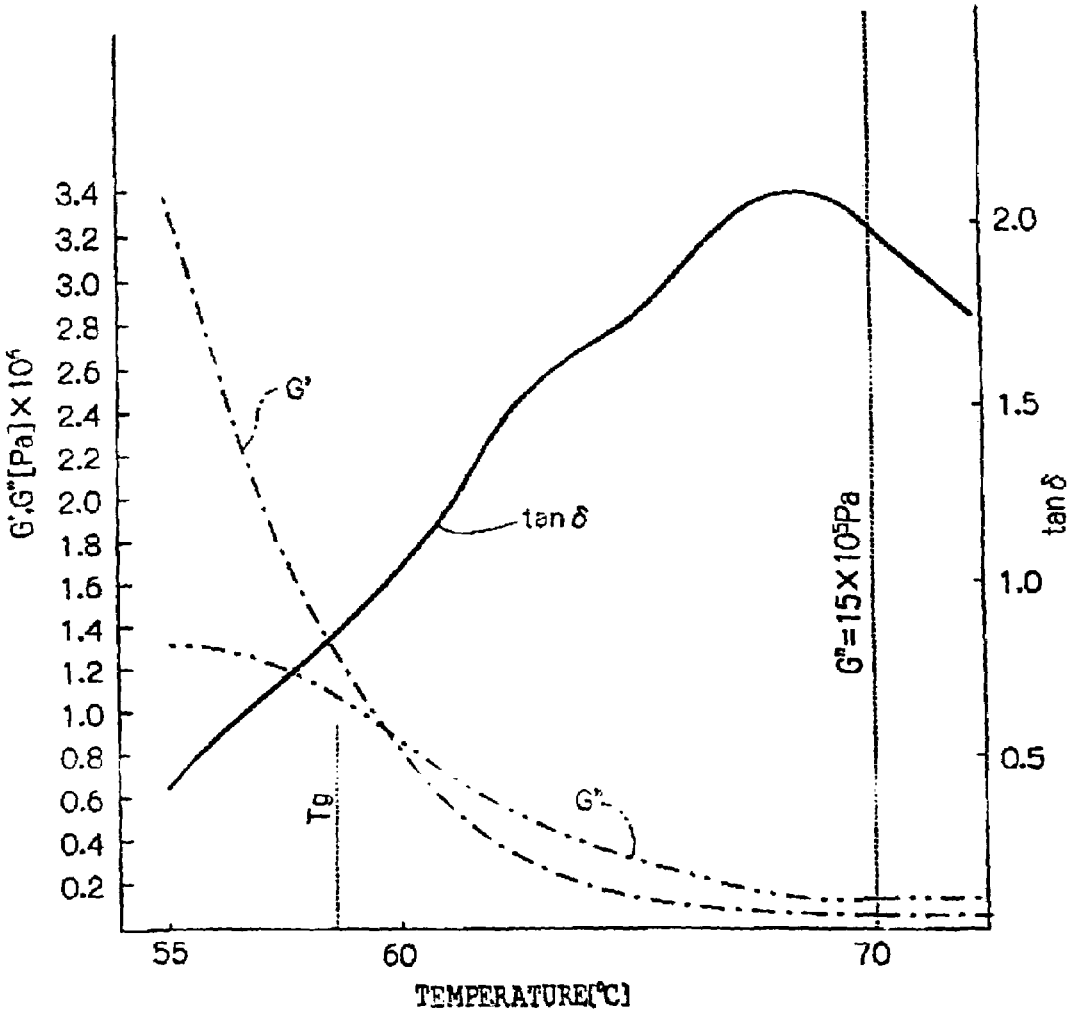
FIG. 1 is a graph showing the viscoelastic characteristics defined as physical properties of the color toner of the present invention.

Hereinafter, the color toner of the present invention is described.

The color toner of the invention comprises at least a binder resin and a colorant, wherein the weight average molecular weight of the binder resin is in the range of from 6000 to 45000, the glass transition temperature (Tg) of the toner is in the range of from 40 to 70° C., the dynamic loss tangent tan δ of dynamic viscoelasticity is in the range of from 0.1 to 2.5 in the temperature range of from the glass transition temperature (Tg) of the toner to the temperature at which the loss modulus (G") is $1\times10^5$ Pa, and the toner contains 3 to 20% by mass of an ester derivative of an alicyclic compound having 1 or more carboxyl groups, a rosin-modified maleic acid or a styrenemaleic acid.

A drawing showing the viscoelastic characteristics defined as physical properties of the color toner of the invention is shown in FIG. 1. FIG. 1 is a graph showing the viscoelastic characteristics defined as physical properties of the color toner of the invention. G' is storage elastic modulus (shown in a single-dot broken line graph in FIG. 1), G" is loss modulus (shown in a two-dot broken line graph in FIG. 1), and tan δ (tan Delta: dynamic loss tangent of dynamic viscoelasticity, shown in a solid line graph in FIG. 1) is tan $\delta=G''/G'$.

These values are obtained by measurement of dynamic viscoelasticity. Briefly, G' is the elasticity response component in the elastic modulus in the relationship with stress generated by distortion upon deformation, in which the energy of deformation stress is stored. G" is the viscosity response component in the elastic modulus, in which the energy of deformation stress is lost as heat. Their ratio i.e. tan δ (=G"/G') can be used as the scale of loss and storage of the energy of deformation stress.

In the color toner of the invention, tan δ is defined to be 2.5 or less in the temperature range of from the glass transition temperature (Tg) of the toner to the temperature at which the loss modulus (G") is $1\times10^5$ Pa, so that even if a fixed image is stored in a slightly softened state at high temperatures, the toner image can be elastic but not sticky, thus improving the storage ability of the image at high temperatures. This is achieved without increasing the glass transition temperature, so that without increasing the fixing temperature, the fixed image can be endowed with high-quality gloss without causing surface roughness due to insufficient heat.

On the other hand, if tan δ is higher than 2.5, the fixed image stored in the temperature range of higher than the glass transition point sticks to an opposing fixed image or to a paper, or one or both of the fixed images are broken to cause an offset phenomenon.

Further, if tan δ is less than 0.1, the modulus of elasticity is too high even in the fixing temperature range, and the molten toner does not penetrate into a paper at the time of fixing, and the fixed image is easily removed and not durable against rubbing stress.

The viscoelastic characteristics in the invention can be measured for example by a rotary planar rheometer (RDA2, manufactured by Rheometric Scientific).

The glass transition temperature (Tg) in the invention can be measured in a usual manner at an increasing temperature of 5° C./min. with e.g. a scanning differential calorimeter.

The volume-average particle size of the color toner particle of the invention is preferably in the range of from 3 to 8 μm to achieve more excellent image qualities. If the volume-average particle size is greater than 8 μm, high qualities may not be achieved, while if the volume-average particle size is less than 3 μm, stable charging may not be attained in some cases.

As the binder resin in the invention, a binder resin obtained in emulsion polymerization, having a preferable weight average molecular weight and Mw/Mn described later, is preferable because it is easily obtained. For emulsion polymerization, a method known in the art can be used.

Preferable examples of the binder resin in the invention include thermoplastic resins which are specifically homopolymers or copolymers (styrene resins) of styrene or derivatives thereof such as p-chlorostyrene and α-methylstyrene; homopolymers or copolymers (vinyl resin) of esters having a vinyl group, such as methyl acrylate, ethyl acrylate, n-propylacrylate, n-butylacrylate, laurylacrylate, 2-ethylhexyl acrylate, methyl methacrylate, ethyl methacrylate, n-propyl methacrylate, lauryl methacrylate and 2-ethylhexyl methacrylate; homopolymers or copolymers (vinyl resin) of vinyl nitriles such as acrylonitrile and methacrylonitile; vinyl ether homopolymers or copolymers (vinyl resin) of vinyl ethyl ether and vinyl isobutyl ether; homopolymers or copolymers (vinyl resin) of vinyl methyl ketone, vinyl ethyl ketone, vinyl isopropenyl ketone etc.; homopolymers or copolymers (olefin resin) of olefins such as ethylene, propylene, butadiene and isoprene; and non-vinyl condensed resins such as epoxy resin, polyester resin, polyurethane resin, polyamide resin, cellulose resin and polyether resin, and graft polymers of these non-vinyl condensed resins with vinyl monomers, among which the vinyl resin is preferable. The vinyl resin is advantageous because a resin dispersion can be easily prepared by emulsion polymerization using an ionic surfactant etc. These resins may be used alone or as a mixture of two or more thereof.

The monomer used as a starting material of the vinyl resin includes, for example, vinyl polymer acids such as acrylic acid, methacrylic acid, maleic acid, cinnamic acid, fumaric acid, vinylsulfonic acid, ethylene imine, vinyl pyridine and vinyl amine, and monomers serving as starting materials of vinyl polymer bases. In the invention, the vinyl monomers are contained preferably as monomer components of the fine resin particles. Among these vinyl monomers, the vinyl polymer acids are preferable for easier reaction to form vinyl resins, and specifically, dissociable vinyl monomers having a carboxyl group as a dissociable group, such as acrylic acid, methacrylic acid, maleic acid, cinnamic acid and fumaric acid, are particularly preferable for regulation of the degree of polymerization and glass transition point.

It is essential that the weight average molecular weight of the binder resin in the invention is in the range of from 6000 to 45000, and when the binder resin is based on polyester, the molecular weight is preferably in the range of from 6000 to 10000, and when the binder resin is based on vinyl resin, the molecular weight is preferably in the range of from 24000 to 36000.

If the weight average molecular weight of the binder resin is higher than 45000, the viscoelasticity at the time of fixing is high, and the fixed image hardly attains a smooth surface necessary for high gloss, while if the weight average molecular weight is lower than 20000, the toner in the fixing step has low melt viscosity and is poor in flocculation, thus causing hot offset.

The molecular weight distribution of the binder resin in the invention, represented by Mw/Mn i.e. the ratio of weight average molecular weight Mw to number average molecular weight Mn, is 3.3 or less, more preferably 2.8 or less. When Mw/Mn is greater than 3.3, the fixed image fails to attain a smooth surface necessary for high gloss. To obtain a color toner having a tan δ of 2.0 or less, Mw/Mn is preferably 2.0 or more.

It is essential that the glass transition point of the binder resin is in the range of from 40 to 70° C., preferably in the range of from 45 to 60° C. If the glass transition temperature is lower than 40° C., the toner powder is thermally blocked, while if the glass transition temperature is higher than 70° C., the fixing temperature becomes too high.

The volume-average particle size of the binder resin in a resin particle dispersion described later is preferably 1 μm or less, more preferably in the range of from 0.01 to 1 μm. When this volume-average particle size is greater than 1 μm, the toner particles may be aggregated and coalesced to broaden their particle size distribution, and free particles maybe generated to cause deterioration in the performance and reliability of the toner. By regulating the volume-average particle size of the binder resin particles in the range of from 1 μm or less, there is an advantage that the dispersion of the fine resin particles in the aggregated particles can be improved thus preventing an uneven composition among the toner particles and reducing inconsistency of toner performance and reliability to a low level. The volume-average particle size can be measured by e.g. a laser diffraction particle size distribution measuring instrument and a Coulter counter.

The colorant in the invention includes, for example, pigments such as carbon black, chrome yellow, Hansa yellow, benzidine yellow, threne yellow, quinoline yellow, permanent orange GTR, pyrazolone orange, vulcan orange, watch young red, permanent red, brilliant carmine 3B, brilliant carmine 6B, Dupont oil red, pyrazolone red, lithol red, rhodamine B lake, lake red C, rose Bengal, aniline blue, ultramarine blue, chalco oil blue, methylene blue chloride, phthalocyanine blue, phthalocyanine green, malachite green oxalate, as well as dyes of acridine, xanthene, azo, benzoquinone, azine, anthraquinone, dioxazine, thiazine, azomethine, indigo, thioindigo, phthalocyanine, aniline black, polymethine, triphenylmethane, diphenylmethane, thiazole and xanthene. These colorants may be used alone or as a mixture of two or more thereof.

The volume-average particle size of the colorant is preferably 1 μm or less, more preferably 0.5 μm or less, still more preferably in the range of from 0.01 to 0.5 μm. When this volume-average particle size is higher than 1 μm, the particle size distribution of the finally obtained color toner may be broadened, free particles may be easily generated, and the performance and reliability of the toner may be easily deteriorated.

By regulating the volume-average particle size of the colorant particles in the range of from 1 μm or less, there is an advantage that the dispersion of the colorant in aggregated particles can be improved thus preventing an uneven composition among the toner particles and reducing inconsistency of toner performance and reliability to a low level. By regulating the volume-average particle size in the range of from 0.5 μm or less, the color toner coloration, color reproduction, OHP transmission etc. can be further improved. The volume-average particle size can be measured by e.g. a laser diffraction particle size distribution measuring instrument.

The content of the colorant in the aggregated particles described later is preferably 50% bymass or less, moreprefrably in the range of from 2 to 20% by mass.

Preferably, the color toner of the invention further comprises a releasing agent.

Generally, unless the releasing agent contained in a color toner is poor in compatibility with a binder resin, the releasing agent may be fused with the binder resin to promote plasticization of the binder resin, and the viscosity of the color toner during fixation at high temperatures maybe loared to cause offset easily, but by incorporation of an ester derivative of an alicyclic compound having one or more carboxyl groups a rosin-modified maleic acid or a styrenemaleic acid, the viscosity of the color toner can be prevented from being reduced, and offset can be prevented from occurring, as described later.

Examples of the releasing agent include silicones showing a softening point upon heating of low-molecular polyolefins such as polyethylene, polypropylene and polybutene; fatty amides such as oleic amide, erucic amide, ricinoleic amide and stearic amide; vegetable wax such as carnauba wax, rice wax, candelilla wax, Japan wax and jojoba oil; animal wax such as beeswax; mineral and petroleum wax such as montan wax, ozokerite, seresin, paraffin wax, microcrystalline wax, Fischer-Tropsch wax, ester waxes of higher fatty acids and higher alcohols, such as stearyl stearate, behenyl behenate etc.; ester waxes of higher fatty acids and monovalent or polyvalent lower alcohols, such as butyl stearate, propyl oleate, glyceride monostearate, glyceride distearate and pentaerythritol tetrabehenate; ester waxes composed of higher fatty acids and polyvalent alcohol polymers, such as diethylene glycol monostearate, dipropylene glycol distearate, diglyceride distearate and triglyceride tetrastearate; sorbitan higher fatty ester waxes such as sorbitan monostearate; cholesterol higher fatty ester waxes such as cholesteryl stearate. These releasing agents maybe used alone or as a mixture of two or more thereof.

The volume-average particle size of the releasing agent in a dispersion described later is preferably 2 $\mu$m or less, more preferably in the range of from 0.1 to 1.5 $\mu$m.

When the volume-average particle size of the releasing agent in the dispersion is greater than 2 $\mu$m, the particle size distribution of the finally obtained toner for developing electrostatic images may be broadened, free particles may be easily generated, and the performance and reliability of the toner may be easily deteriorated.

By regulating the volume-average particle size of the releasing agent in the dispersion in the range described above, there is an advantage that an uneven composition among the toner particles can be prevented, and inconsistency of toner performance and reliability can be reduced to a low level. The volume-average particle size can be measured by e.g. a laser diffraction particle size distribution measuring instrument or a centrifugation particle size distribution measuring instrument.

The viscoelastic characteristics of the color toner of the invention are achieved by incorporation of an ester derivative of an alicyclic compound having one or more carboxyl groups, a rosin-modified maleic acid or a styrenemaleic acid (hereinafter, also called the "compound in the invention").

The compound in the invention is desirably compatible with the resin, and the difference in solubility parameter (SP value) between the resin and the compound is preferably 4 or less, more preferably 2.8 or less.

The cyclic structure constituting the alicyclic compound as the ester derivative of an alicyclic compound having one or more carboxyl groups (hereinafter, also called the "ester derivative in the invention") is not particularly limited insofar as it has one or more carboxyl groups and has a cyclic structure with partially unsaturated bonds, and examples thereof include cycloalkene structures such as cyclohexene, dicyclohexadiene, cyclopentene, dicyclopentadiene etc.; partially hydrogenated aromatic structures having a polycyclic structure such as naphthalene, anthracene, phenanthrene, azulene, pyrene etc.; tetracyclic triterpenoides such as terpenes i.e. monoterpenes, sesquiterpenes, diterpenes, triterpenes, tetraterpenes, protostane, lanostane, euphane, damarane skeleton, kukurubitane etc.; pentacyclic triterpenoides such as oleanane, ursane, lupane, hoban, freederane, cycloaltane etc.; and cyclic structures such as steroid skeleton, and these may be used alone or as a mixture thereof.

The ester derivative in the invention can be obtained by esterifying an alicyclic compound having the above cyclic structure with a monovalent or divalent alcohol. Preferable examples of the resulting ester derivative include rosin ester, rosin-modified glycerin ester and rosin-modified pentaerythritol ester. Other preferable examples of the compound in the invention include rosin-modified maleic acid and styrenemaleic acid.

The softening point of the compound in the invention is preferably from 135° C. to 160° C., more preferably from 135° C. to 150° C. When the softening point of the compound is less than 135° C., its difference from the softening point of the binder resin is too great, so the compound at the time of fixation may not be uniformly dispersed in the resin, thus generating domains. When the softening point of the compound is higher than 160° C., uneven melting may occur at the time of fixation, and coloration and OHP transmission may be deteriorated.

It is essential that the content of the compound in the color toner of the invention is 3 to 20% by mass, preferably 3 to 15% by mass, more preferably 5 to 10% by mass.

When the content of the compound in the color toner of the invention is less than 3%, the viscoelastic characteristics of the color toner of the invention cannot be attained. On the other hand, when the content is higher than 20% by mass, gelling occurs and the gloss of the fixed image obtained by using the color toner of the invention is deteriorated.

As the compound in the invention, two or more compounds may be used insofar as the content thereof in the color toner of the invention is within the range of from 3 to 20% by mass.

Preferably, the method of producing the color toner of the invention comprises preferably at least the step of preparing a mixed solution, and more preferably, the method further comprises the step of forming aggregated particles, the fusion step and the step of cooling. Further, the method of producing the color toner of the invention comprises the step of forming adhered particles after the step of forming aggregated particles and before the fusion step.

In the invention, the method can further comprise other steps as necessary.

The step of preparing a mixed solution is the step of dispersing fine particles of the binder resin and colorant in aqueous mediums respectively and mixing the respective dispersions to prepare a mixed solution, and the compound in the invention is also preferably mixed in this step. The step of forming aggregated particles is the step of forming aggregated particles in the mixed solution to prepare a dispersion of the aggregated particles. The fusion step is the step of heating the aggregated particles to fuse them. The step of forming adhered particles is the step of adding a fine particle dispersion having fine particles dispersed in an aqueous medium to the aggregated particle dispersion, mixing them, and permitting the fine particles to adhere to the aggregated particles, to form adhered particles. The step of cooling is the step of cooling the color toner obtained in the fusion step.

In the step of preparing the mixed solution in the method of producing the color toner of the invention, the fine binder resin particles, fine colorant particles etc. are uniformly dispersed and mixed in the mixed solution of the binder resin particle dispersion, the colorant particle dispersion etc.

In the step of forming the aggregated particles, the fine binder resin particles, fine colorant particles etc. dispersed uniformly in the mixed solution are aggregated to form aggregated particles.

In the fusion step, the resin in the aggregated particles is melted and fused to form color toner particles.

In the step of forming the adhered particles, the fine particles contained in the fine particle dispersion added to and mixed with the aggregated particle dispersion having the aggregated particles dispersed therein adhere to the surfaces of the aggregated particles as core particles, to form adhered particles. If the step of forming adhered particles is carried out before the fusion step, the resin in the adhered particles is melted and fused in the fusion step, to form toner particles for developing electrostatic images.

The distribution of the fine colorant particles in the aggregated particles finally becomes the distribution of colorant particles in the toner particles so that as the dispersion of the colorant particles becomes low and uniform, the coloration of the resulting toner particles is improved. In the step of the forming the aggregated particles in the method of producing the color toner of the invention, the fine colorant particles are uniformly dispersed in the aggregated particles, and thus the resulting color toner particles are very excellent in coloration. This coloration is important because it affects color reproduction and OHP transmission, and the toner for developing electrostatic images obtained by the method of producing the color toner of the invention is advantageous in respect of color reproduction and OHP transmission. Further, the color toner particles are advantageous in that they are easily cleaned and are excellent in charging properties, and their characteristics, particularly charging properties, are not easily changed depending on environmental conditions.

The step of preparing the mixed solution is the step of at least mixing a resin particle dispersion having the fine binder resin particles dispersed in an aqueous medium, with a colorant particle dispersion having the fine colorant particles dispersed in an aqueous medium, to prepare a mixed solution.

The combination of the fine colorant particles and the fine binder resin particles is not particularly limited, and can be arbitrarily selected depending on the object.

The step of preparing the mixed solution preferably comprises mixing a particle dispersion having the fine releasing agent particles dispersed therein, in addition to the resin particle dispersion, the colorant particle dispersion and the compound in the invention.

Fine particles of an internal additive, a charge controlling agent, fine inorganic particles, fine organic particles, fine particles of a lubricant and an abrasive may be mixed with the particle dispersion. These fine particles which may be mixed are not particularly limited and can be suitably selected depending on the object.

In the invention, these fine particles such as fine releasing agent particles may be dispersed in the resin particle dispersion or the colorant particle dispersion.

The additive includes, for example, magnetic materials including metals such as ferrite, magnetite, reduced iron, cobalt, nickel and manganese, alloys thereof, or compounds containing these metals.

The charge controlling agent includes, for example, particles of dyes made of quaternary ammonium salt compounds, Nigrosine compounds, and complexes of aluminum, iron and chrome, and triphenyl methane pigment. The charge controlling agent particles in the invention are made preferably of a material sparingly soluble in water for regulation of ionic strength affecting stability upon flocculation or fusion and for reduction of drainage pollution.

The fine inorganic particles include, for example, the same particles as usually used as external additives on the surface of the toner, for example silica, alumina, titania, calcium carbonate, magnesium carbonate, calcium phosphate and cerium oxide.

The fine organic particles include, for example, the same particles as usually used as external additives on the surface of the conventional toner, for example vinyl resin, polyester resin, silicone resin etc. These fine inorganic or organic particles can also be used as fluidizing assistants and cleaning assistants.

The lubricant includes, for example, fatty amides such as ethylene bisstearic amide, oleic amide etc., and metal salts of fatty acids, such as zinc stearate, calcium stearate etc.

The abrasive includes, for example, the above-mentioned silica, alumina, cerium oxide etc.

The volume-average particle size of these fine particles is preferably 1 $\mu$m or less, more preferably in the range of from 0.01 to 1 $\mu$m. When the volume-average particle size is greater than 1 $\mu$m, the particle size distribution of the finally obtained toner for developing electrostatic images may be broadened, free particles may be generated, and the performance and reliability of the toner may be deteriorated.

By regulating the volume-average particle size in the range described above, there is an advantage that an uneven composition among the toner particles can be prevented, and inconsistency of toner performance and reliability can be reduced to a low level. The volume-average diameter can be measured by e.g. a laser diffraction particle size distribution measuring instrument or a centrifugation particle size distribution measuring instrument.

The aqueous medium contained in the resin particle dispersion, the colorant particle dispersion and the particle dispersion includes, for example, water such as distilled water, deionized water etc., alcohols, etc. These may be used alone or as a mixture thereof.

The content of the polar surfactant in the polar dispersant cannot be generally defined and can be selected depending on the object.

The aqueous medium preferably contains a polar surfactant, and the polar surfactant includes, for example, anionic surfactants based on sulfates, sulfonates, phosphates, soaps etc.; and cationic surfactants based on amine salts, quaternary ammonium salts etc.

Examples of the anionic surfactant includes sodium dodecylbenzenesulfonate, sodium dodecylsulfate, sodium alkylnaphthalenesulfonate, sodium dialkylsulfosuccinate etc.

Examples of the cationic surfactant include alkylbenzenedimethyl ammonium chloride, alkyltrimethyl ammonium chloride, distearyl ammonium chloride etc.

These may be used alone or in combination thereof.

In the invention, the polar surfactant may be used in combination with a non-polar surfactant. The non-polar surfactant includes, for example, nonionic surfactants based on polyethylene glycol, alkylphenol ethylene oxide adducts, polyvalent alcohols, etc.

The content of the resin particles in the resin particle dispersion is usually 5 to 60% by mass, preferably 10 to 40% by mass. The content of the resin particles in the aggregated particle dispersion upon formation of aggregated particles may be up to 50% by mass, more preferably 2 to 40% by mass.

Fine particles other than those described above can be added if necessary in such a range that the effect of the invention is not inhibited, and their amount is generally very small, specifically in the range of from about 0.01 to 5% by mass, preferably 0.01 to 3% by mass, in the aggregated particle dispersion upon formation of the aggregated particles.

The step of forming the aggregated particles is the step of forming aggregated particles in the mixed solution to prepare a aggregated particle dispersion.

Addition and mixing of the flocculating agent is conducted preferably at a temperature equal to or below the glass transition point of the resin contained in the mixed solution. By mixing under this temperature condition, flocculation proceeds in a stable state.

For mixing, a mixing device known per se, for example, a homogenizer, a mixer or the like can be used.

The volume-average particle size of the aggregated particles thus formed is not particularly limited, but usually regulated to be the same degree as the volume-average particle size of the desired color toner. This regulation can be easily conducted by suitable establishment and change of the temperature and conditions for stirring and mixing.

In the step of forming the aggregated particles as described above, the aggregated particles having almost the same volume-average particle size as that of the toner for developing electrostatic images are formed, and a aggregated particle dispersion containing the aggregated particles dispersed therein is prepared. In the invention, the aggregated particles are also referred to as "core particles".

The step of forming the adhered particles is the step of mixing a fine particle dispersion having fine particles dispersed in an aqueous medium, with the aggregated particle dispersion, and permitting the fine particles to adhere to the aggregated particles to form adhered particles, and this step can be carried out if necessary.

The fine particles in the step of forming adhered particles are not particularly limited, and can be selected suitably depending on the object, and include fine resin particles identical with the above resin particles, fine colorant particles identical with the colorant particles, fine particles identical with the releasing agent particles, etc. Among these, fine resin particles are preferable in the invention. The fine particles are particles added newly to the aggregated particles, and thus also referred to "additional particles" in the invention.

The means of preparing the fine particle dispersion is the same as for the resin particle dispersion, the colorant particle dispersion and the particle dispersion described above.

The volume-average particle size of the fine resin particles in the step of forming the adhered particles is usually 1 $\mu$m or less, preferably in the range of from 0.01 to 1 $\mu$m. When the volume-average particle size is greater than 1 $\mu$m, the particle size distribution of the finally obtained toner for developing electrostatic images may be broadened, free particles may be generated, and the performance and reliability of the toner may be deteriorated. By regulating the volume-average particle size in the range described above, there is none of the above problems and there is an advantage that a layer structure of fine resin particles is formed. The volume-average particle size can be measured by e.g. a Coulter counter.

The volume of the fine particles in the step of forming adhered particles depends on the volume fraction of the resulting color toner, and is preferably not higher than 50% by volume of the resulting color toner. When the volume of the fine particles in the step of forming adhered particles is greater than 50% by mass of the resulting toner for developing electrostatic images, the fine particles in the step of forming adhered particles neither adhere to the aggregated particles nor flocculate, and the fine particles in the step of forming adhered particles form new aggregated particles, and the distribution of the composition of the resultant toner for developing electrostatic images and the particle size distribution are significantly varied so that the desired performance may not be achieved.

The fine particle dispersion may be a fine particle dispersion comprising only one kind of the above fine particles dispersed therein or a fine particle dispersion comprising a combination of two or more kinds of the fine particles dispersed therein. In the latter case, a combination of the fine particles is not particularly limited and can be suitably selected depending on the object.

The content of the fine particles in the fine particle dispersion is usually 5 to 60% by mass, preferably 10 to 40% bymass. When the content is outside of this range, the structure and composition of from the inside to the surface of the toner for developing electrostatic images may not be sufficiently regulated. Upon formation of aggregated particles, the content of the aggregated particles in the aggregated particle dispersion is usually not higher than 40% by mass.

The fusion step is the step of heating the aggregated particles or adhered particles to fuse them.

The heating temperature may be from the glass transition temperature of the resin contained in the aggregated particles or adhered particles to the decomposition temperature of the resin. Accordingly, the heating temperature is varied depending on the resin in the resin particles and in the fine resin particles, and cannot be defined generally, but generally the heating temperature is from the glass transition temperature of the resin contained in the aggregated particles or adhered particles to 180° C.

Heating can be carried out using a heating device and instrument known per se.

The fusing time is short when the heating temperature is high, and a longer time is necessary when the heating temperature is lower. That is, the fusing time depends on the heating temperature and cannot be defined generally, but generally it is 30 minutes to 10 hours.

In the invention, the color toner obtained after the fusion step can be ished, dried etc. under suitable conditions. Inorganic particles such as silica, alumina, titania and calcium carbonate or resin particles such as vinyl resin, polyester resin and silicone resin may be added in a dry state under application of shear strength, to the surface of the resultant toner for developing electrostatic images. These inorganic particles and resin particles function as external additives such as fluidizing assistants or cleaning assistants.

The aggregated particles or the adhered particles in the form of the aggregated particles (core particles) as such or the aggregated particles (core particles) having the fine particles (additional particles) adhering thereto are fused in the fusion step.

The color toner obtained in the fusion step is cooled in the cooling step described above, to give the color toner of the invention.

For the color toner of the invention, its composition can be selected depending on the object. The color toner may be methacrylic acid, used as a single-component developer or may be combined with a carrier for use as a two-components developer, but for the purpose of high process speed in the invention, the color toner is used preferably as a two-components developer suitable for high speed.

The carrier used is not particularly limited, and a carrier known per se can be used.

Examples of the carrier include a carrier coated with a resin. As the core particles of the carriers coated with a resin, particles of usual iron powder, ferrite or magnetite can be used, and the volume-average particle size is preferably in the range of from 30 to 200 $\mu$m.

The coating resin for the core particles include, for example, homopolymers or copolymers of two or mono monomers such as styrene or derivatives thereof such as p-chlorostyrene and $\alpha$-methyl styrene; $\alpha$-methylene fatty monocarboxylates such as methyl acrylate, ethyl acrylate, n-propyl acrylate, lauryl acrylate, 2-ethylhexyl acrylate, methyl methacrylate, n-propyl methacrylate, lauryl methacrylate and 2-ethylhexyl methacrylate; nitrogen-containing acryl derivatives such as dimethylaminoethyl methacrylate; vinyl nitriles such as acrylonitrile and methacrylonitrile; vinyl pyridines such as 2-vinylpyridine and4-vinylpyridine; vinyl ethers such as vinyl methyl ether and vinyl isobutyl ether; vinyl ketones such as vinyl methyl ketone, vinyl ethyl ketone and vinyl isopropenyl ketone; olefins such as ethylene and propylene; and vinyl fluorine-containing monomers such as vinylidene fluoride, tetrafluoroethylene and hexafluoroethylene, as well as silicones such as methyl silicone and methyl phenyl silicone; polyesters containing bisphenol, glycol etc.; epoxy resin, polyurethane resin, polyamide resin, cellulose resin, polyether resin, polycarbonate resin etc. These resins may be used alone or as a mixture of two or more thereof. The amount of the coating resin is in the range of from 0.1 to 10 parts by mass, preferably 0.5 to 3.0 parts by mass, relative to 100 parts by mass of the core particles.

For production of the carrier coated with a resin, a heating kneader, heating Henschel mixer, UM mixer etc. can be used. Depending on the amount of the coating resin, a heated fluidized rolling bed, a heated kiln etc. can be used. The mixing ratio of the toner to the carrier in the electrostatic images developer of the invention is not particularly limited, and can be suitably determined depending on the object.

The image forming method according to the invention is an image forming method, which comprises the steps of forming an electrostatic latent image, on an image holding member, depending on image information, visualizing the electrostatic latent image as a toner image by a developer, transferring the toner image onto a transfer material, and fixing the transfer material having the toner image transferred thereto by an image-fixing device, wherein the developer comprises the toner of the invention.

The respective steps in the image forming method in the invention are general steps, which are described in e.g. JP-A Nos. 56-40868, 49-91231, etc. The image forming method in the invention can be performed by using an image forming unit known per se, such as a copying machine, a facsimile etc.

In the step of forming an image, the electrostatic latent image is developed by a layer of a developer arranged on the surface of a developer holding member in a developing device to form a toner image. The layer of a developer is not particularly limited insofar as it contains a developer containing the toner of the invention.

Insofar as the relationship between the fixing temperature and the heating time described above can be satisfied, the fixing device used in obtaining a fixed image with the color toner of the invention is not particularly limited, and a fixing device known per se can be used.

A heating member in the fixing device preferably has a release layer. The release layer is made preferably of a material excellent in releasability from the toner, for example silicone rubber, fluorine resin etc. for the purpose of preventing the toner from adhering thereto. Examples of the fluorine resin include a copolymer of tetrafluoroethylene and perfluoroalkyl vinyl ether, a copolymer of tetrafluoroethylene and ethylene, and a copolymer of tetrafluoroethylene and hexafluoroethylene. The thickness of the release layer can be selected depending on the object, but is preferably 10 to 60 $\mu$m.

In the fixing device, a liquid releasing agent may be used in an amount of 1 $\mu$l or less/A4 paper for the purpose of securing a region for fixation at high temperatures.

As the base material for the fixing device, a material which is excellent in heat resistance, has strong strength against deformation and superior in heat conductivity is selected, and in the case of a roll-fixing device, for example aluminum, iron, copper etc. are selected, and in the case of a belt-fixing device, for example a polyimide film, stainless steel belt etc. are selected.

EXAMPLES

Hereinafter, the present invention is described in more detail by reference to the Examples, but these examples are not intended to limit the invention. The term "parts" refers to "parts by mass".

The color toner volume-average particle size D50 is measured by a Coulter counter (TA2, Coulter Co., Ltd.).

The volume-average particle sizes of fine binder resin particles, fine colorant particles and fine releasing agent particles are measured by a laser diffraction particle size distribution measuring instrument (LA-700, Horiba, Ltd.).

The molecular weight and molecular weight distribution of the binder resin in aggregated particles and the coating resin are measured by gel permeation chromatography (HLC-8120GPC, Tosoh Corporation). The glass transition point of the binder resin particles is measured under the condition of an increasing temperature of 3° C./min. with a differential scanning calorimeter (DSC-50, Shimadzu Corporation).

Storage elastic modulus G' and loss modulus G" (that is, tan $\delta$) are determined by measuring about 0.3 g sample with 20% or less distortion applied at a frequency of 1 rad/sec. with parallel plates of 8 mm in diameter at an increasing temperature of 1° C./min. from about 40 to 150° C. in a rotary planar rheometer (RDA2, RH10S System ver. 4.3, manufactured by Rheometric Scientific).

As the gloss, 75° gloss is measured by a gloss meter (Model GM-26D for 75°, Murakami Color Research Laboratory).

[Preparation of Resin Dispersion (1)]

Styrene: 350 parts

Butyl acrylate: 50 parts

Acrylic acid: 8 parts

Dodecyl mercaptan: 10 parts

Carbon tetrabromide: 3 parts

The components described above are previously mixed and dissolved to prepare solution (a). Separately, 7 parts of a nonionic surfactant (Noboneal, Sanyo Chemical Industries, Ltd.) and 10 parts of an anionic surfactant (Neogen R, Dai-ichi Kogyo Seiyaku Co., Ltd.) are dissolved in 520 parts of deionized water, to prepare solution (b). The solutions (a) and (b) are introduced into a flask, dispersed, emulsified, and mixed slowly for 10 minutes. Further, 70 parts of deionized water having 3 parts of ammonium persulfate dissolved therein are introduced into the flask, and then flask is flushed with nitrogen. Thereafter, the mixture is heated to 70° C. in the flask under stirring on an oil bath, and the emulsion polymerization is continued as such for 6 hours. Thereafter, this reaction solution is cooled to room temperature to give a resin dispersion (1) having a volume-average particle size of 152 nm, a glass transition point of 53.2° C., Mw/Mn of 2.4, and a weight average molecular weight of 24000.

[Preparation of Resin Dispersion (2)]

Polyester (polycondensate of bisphenol A to which 2 mol propylene oxide is added/bisphenol A to which 3 mol propylene oxide is added/phenol novolak to which 5.5 mol ethylene oxide is added/terephthalic acid/trimellitic anhydride/dimethyl terephthalate): 220 parts Tetrahydrofuran: 300 parts Polyethylene glycol: 20 parts Deionized water: 500 parts The components described above are previously mixed and dissolved to prepare a solution which is then dispersed for 15 minutes with a rotor stator homogenizer (Ultratarax, produced by IKA Co., Ltd.), then heated and left at 80° C. for 4 hours. The dispersion is then cooled to give a resin dispersion (2) having a volume-average particle size of 180 nm, a glass transition point of 52.3° C., Mw/Mn of 2.7, and a weight average molecular weight of 22000.

[Preparation of Resin Dispersion (3)]

Styrene: 350 parts

Butyl acrylate: 50 parts

Acrylic acid: 8 parts

Dodecyl mercaptan: 7 parts

Carbon tetrabromide: 3 parts

The components described above are previously mixed and dissolved to prepare solution (e). Separately, 7 parts of a nonionic surfactant (Noboneal, Sanyo Chemical Industries, Ltd.) and 10 parts of an anionic surfactant (Neogen R, Dai-ichi Kogyo Seiyaku Co., Ltd.) are dissolved in 520 parts of deionized water, to prepare solution (d). The solutions (c) and (d) are introduced into a flask, dispersed, emulsified, and mixed slowly for 10 minutes. Further, 70 parts of deionized water having 3 parts of ammonium persulfate dissolved therein are introduced into the flask, and then flask is flushed with nitrogen. Thereafter, the mixture is heated to 70° C. in the flask under stirring on an oil bath, and the emulsion polymerization is continued as such for 6 hours. Thereafter, this reaction solution is cooled to room temperature to give a resin dispersion (3) having a volume-average particle size of 140 nm, a glass transition point of 55.2° C., Mw/Mn of 2.8, and a weight average molecular weight of 36000.

[Preparation of Resin Dispersion (4)]

Styrene: 350 parts

Butyl acrylate: 50 parts

Acrylic acid: 8 parts

Dodecyl mercaptan: 7 parts

Carbon tetrabromide: 3 parts

The components described above are previously mixed and dissolved to prepare solution (c). Separately, 7 parts of a nonionic surfactant (Noboneal, Sanyo Chemical Industries, Ltd.) and 10 parts of an anionic surfactant (Neogen R, Dai-ichi Kogyo Seiyaku Co., Ltd.) are dissolved in 520 parts of deionized water, to prepare solution (f). The solutions (e) and (f) are introduced into a flask, dispersed, emulsified, and mixed slowly for 10 minutes. Further, 70 parts of deionized water having 3 parts of ammonium persulfate dissolved therein are introduced into the flask, and then flask is flushed with nitrogen. Thereafter, the mixture is heated to 85° C. in the flask under stirring on an oil bath, and the emulsion polymerization is continued as such for 5 hours. Thereafter, this reaction solution is cooled to room temperature to give a resin dispersion (4) having a volume-average particle size of 160 nm, a glass transition point of 58.9° C., Mw/Mn of 3.7, and a weight average molecular weight of 48000.

[Preparation of Resin dispersion (5)]

Styrene: 900 parts

Butyl acrylate: 10 parts

Acrylic acid: 8 parts

Dodecyl mercaptan: 1 part

The components described above are previously mixed and dissolved to prepare solution (g). Separately, 7 parts of a nonionic surfactant (Noboneal, Sanyo Chemical Industries, Ltd.) and 10 parts of an anionic surfactant (Neogen R, Dai-ichi Kogyo Seiyaku Co., Ltd.) are dissolved in 520 parts of deionized water, to prepare solution (h). The solutions (g) and (h) are introduced into a flask, dispersed, emulsified, and mixed slowly for 10 minutes. Further, 70 parts of deionized water having 1 part of ammonium persulfate dissolved therein are introduced into the flask, and then flask is flushed with nitrogen. Thereafter, the mixture is heated to 85° C. in the flask under stirring on an oil bath, and the emulsion polymerization is continued as such for 5 hours. Thereafter, this reaction solution is cooled to room temperature to give a resin dispersion (5) having a volume-average particle size of 210 nm, a glass transition point of 76.6° C., Mw/Mn of 5.2, and a weight average molecular weight of 30000.

[Preparation of Resin Dispersion (6)]

Styrene: 280 parts

Butyl acrylate: 10 parts

Acrylic acid: 8 parts

Dodecyl mercaptan: 1 part

The components described above are previously mixed and dissolved to prepare solution (i). Separately, 7 parts of a nonionic surfactant (Noboneal, Sanyo Chemical Industries, Ltd.) and 10 parts of an anionic surfactant (Neogen R, Dai-ichi Kogyo Seiyaku Co., Ltd.) are dissolved in 520 parts of deionized water, to prepare solution (j). The solutions (i) and (j) are introduced into a flask, dispersed, emulsified, and mixed slowly for 10 minutes. Further, 70 parts of deionized water having 3 parts of ammonium persulfate dissolved therein are introduced into the flask, and then flask is flushed with nitrogen. Thereafter, the mixture is heated to 70° C. in the flask under stirring on an oil bath, and the emulsion polymerization is continued as such for 5 hours. Thereafter, this reaction solution is cooled to room temperature to give a resin dispersion (6) having a volume-average particle size of 152 nm, a glass transition point of 44.7° C., Mw/Mn of 2.4, and a weight average molecular weight of 18000.

[Preparation of Colorant Dispersion (1)]

Phthalocyanine pigment (PVFASTBLUE, Dainichiseika Color & Chemicals Mfg. Co., Ltd.): 70 parts Anionic surfactant (Neogen, Dai-ichi Kogyo Seiyaku Co., Ltd.): 3 parts Deionized water: 400 parts The components described above are mixed, dissolved, and dispersed with a homogenizer (Ultratarax, produced by IKA Co., Ltd.) to give a colorant dispersion (1) comprising the dispersed colorant (phthalocyanine pigment) having a volume-average particle size of 150 nm.

[Preparation of Releasing Agent Dispersion (1)]

Polyethylene wax (POLYWAX 655 with a melting point 93° C., Toyo-Petrolite): 100 parts Anionic surfactant (Pionion A-45-D, Takemoto Oil & Fat Co., Ltd.): 2 parts Deionized water: 500 parts The components described above are mixed, dissolved, dispersed with a homogenizer (Ultratarax, produced by IKA Co., Ltd.), and then subjected to dispersion treatment with a pressure discharge homogenizer to give a releasing agent dispersion (1) comprising the dispersed fine releasing agent particles (polyethylene wax) having a volume-average particle size of 280 nm.

EXAMPLE 1

Resin dispersion (1): 300 parts
Colorant dispersion (1): 200 parts
Releasing agent dispersion (1): 110 parts
Rosin-modified maleic acid (softening point 139° C.): 60 parts (9.2% by mass)
Cationic surfactant (Sanizol B50, Kao Corporation): 3 parts
Deionized water: 500 parts The above components are mixed and dispersed with a homogenizer (Ultratarax T50, produced by IKA Co., Ltd.) in a round stainless steel flask to prepare a mixed solution, and then heated to 50° C. under stirring on a heating oil bath and kept at 50° C. for 30 minutes to form aggregated particles. When a part of the resulting aggregated particles are observed under an optical microscope, the volume-average particle size of the aggregated particles is about 5.1 μm. 80 parts of the resin dispersion (1) are added gently to this aggregated fluid and heated at 50° C. for 30 minutes under stirring, to give aggregated particle dispersion A. When the resulting aggregated particle dispersion A is observed under an optical microscope, the volume-average particle size of the aggregated particles is about 5.7 μm.

Then, 6 parts of an anionic surfactant sodium dodecylbenzenesulfonate (Neogen SC, produced by Daiichi Industries, Ltd.) are further added to the aggregated particle dispersion A, heated to 97° C., kept as such for 7 hours to fuse the aggregated particles. Thereafter, the mixture is cooled to 45° C. at a decreasing temperature of 1.0° C./min., filtered, sufficiently ished with deionized water, and filtered through a 400-mesh screen. The volume-average particle size of the fused particles, as measured with a Coulter counter, is 5.8 μm. These are dried in a vacuum drying oven to give toner particle A.

2.0 parts of colloidal silica (R972, produced by Nippon Aerogel Co., Ltd.) are added to 100 parts of the resulting toner particle A and mixed by a Henschel mixer to give color toner A.

The glass transition temperature of the resulting color toner A is 52.8° C. The tan δ is 0.22 at the glass transition temperature, and the tan δ at the temperature (78.6° C.) at which G" is $1\times10^5$ Pa is 1.76. The maximum tan δ and minimum tan δ in the temperature range of from the glass transition temperature to the temperature at which G" is $1\times10^5$ Pa are 1.88 and 0.22, respectively.

The resulting color toner A previously weighed on a glass vessel is mixed for 5 minutes on a ball mill with ferrite carriers having a volume-average particle size of 50 μm coated with 1% polymethylmethacrylate (Soken Chemical & Engineering Co., Ltd.) such that the density of the toner relative to the ferrite carriers is 5% by mass, whereby developer (A) is obtained.

(Evaluation)

The resultant developer (A) is set in a VIVACE400 modified machine (fixing device is composed of a heating roll and a belt; nip width is 7 mm), and toner images are formed on a mirror coat paper (Fuji Xerox Office Supply Co., Ltd.) and on a J Coat paper (Fuji Xerox Co., Ltd.) at a toner density adjusted to 4.0 mg/cm$^2$, then fixed at a fixing temperature of 180° C. at a process speed of 180 mm/sec.

[Gloss of the Fixed Images]

The gloss of the fixed image on the mirror coat paper and the gloss of the mirror coat paper are measured. The measurement of the gloss of the fixed image on the mirror coat paper, and the difference between the gloss of the fixed image on the mirror coat paper and the gloss of the mirror coat paper are evaluated in the following criteria. The results are shown in Table 1. The gloss of the mirror coat paper is 81.

Because a difference of 10 or more in gloss caused a sense of incongruity in visual sensitivity, the following criteria are used.

○: When the gloss of the fixed image on the mirror coat paper is 71 or more (=81 [gloss of the mirror coat paper] minus 10).

X: When the gloss of the fixed image on the mirror coat paper is less than 71 (=81 [gloss of the mirror coat paper] minus 10).

[Storage Test]

Two J Coat papers having fixed images thereon are layered such that the fixed images are contacted with each other, then subjected to a loading of 2.45 MPa (250 g/cm$^2$) and stored under this stress at 60° C. for 1 week, and whether defects occurred on the fixed images is confirmed with naked eyes and evaluated in the following criteria. The results are shown in Table 1.

○: There are no defects on the fixed images after storage under stress.

X: There are defects on the fixed images after storage under stress.

[Bending Test]

A J Coat paper having a fixed image thereon is bent in two at the portion of the fixed image, and a loading of 3 MPa (300 g/cm$^2$) is applied to that portion for 10 seconds, and the destroyed state of the fixed image is confirmed with naked eyes and evaluated in the following criteria. The result are shown in Table 1.

○: There are no defects on the fixed image at the bent portion.

X: There are defects on the fixed image at the bent portion.

EXAMPLE 2

Resin dispersion (2): 300 parts
Colorant dispersion (1): 200 parts
Releasing agent dispersion (1): 110 parts
Styrenemaleic acid (softening point 148° C.): 90 parts (12.8% by mass)
Cationic surfactant (Sanizol B50, Kao Corporation): 3 parts
Deionized water: 500 parts The above components are mixed and dispersed with a homogenizer (Ultratarax T50, produced by IKA Co., Ltd.) in a round stainless steel flask, and then heated to 50° C. under stirring on a heating oil bath and kept at 54° C. for 60 minutes to form aggregated particles. When a part of the resulting aggregated particles are observed under an optical microscope, the volume-average particle size of the aggregated particles is about 5.9 μm. 100 parts of the resin dispersion (2) are added gently to this aggregated fluid and heated at 54° C. for 30 minutes under stirring, to give aggregated particle dispersion B. When the resulting aggregated particle dispersion B is observed under an optical microscope, the volume-average particle size of the aggregated particles is about 6.5 μm.

Then, 6 parts of an anionic surfactant sodium dodecylbenzenesulfonate (Neogen SC, produced by Daiichi Industries, Ltd.) is further added to the aggregated particle dispersion B, heated to 97° C., kept as such for 7 hours to fuse the aggregated particles. Thereafter, the mixture is cooled to 45° C. at a decreasing temperature of 1.0° C./min., filtered, sufficiently ished with deionized water, and filtered through a400-mesh screen. The volume-average particle size of the fused particles, as determined with a Coulter counter, is 6.5 μm. These are dried in a vacuum drying oven to give toner particle B.

1.6 parts of colloidal silica (R972, produced by Nippon Aerogel Co., Ltd.) are added to 100 parts of the resulting toner particle B and mixed by a Henschel mixer to give developer (B).

The glass transition temperature of the resulting developer (B) is51.6° C. The tan δ is0.18 at the glass transition temperature, and the tan δ at the temperature (77.3° C.) at which G" is $1\times10^5$ Pa is 1.55. The maximum tan δ and minimum tan δ in the temperature range of from the glass transition temperature to the temperature at which G" is $1\times10^5$ Pa are 1.60 and 0.18, respectively.

The resulting developer (B) is used to fix a fixed image in the same manner as in Example 1 and evaluated in the same manner as in Example 1. The results are shown in Table 1.

EXAMPLE 3

Resin dispersion (1): 300 parts
Colorant dispersion (1): 200 parts
Releasing agent dispersion (1): 110 parts
Styrenemaleic acid (softening point 155° C.): 40 parts (6.1% by mass)
Cationic surfactant (Sanizol B50, Kao Corporation): 3 parts
Deionized water: 500 parts The above components are mixed and dispersed with a homogenizer (Ultratarax T50, produced by IKA Co., Ltd.) in a round stainless steel flask, then heated to 50° C. under stirring on a heating oil bath and kept at 52° C. for 40 minutes to form aggregated particles. When a part of the resulting aggregated particles are observed under an optical microscope, the volume-average particle size of the aggregated particles is about 5.3 μm. 50 parts of the resin dispersion (1) are added gently to this aggregated fluid and heated at 52° C. for 30 minutes under stirring, to give aggregated particle dispersion C. When the resulting aggregated particle dispersion C is observed under an optical microscope, the volume-average particle size of the aggregated particles is about 5.7 μm.

Then, 6 parts of an anionic surfactant sodium dodecylbenzenesulfonate (Neogen S C, produced by Daiichi Industries, Ltd.) are further added to the aggregated particle dispersion C, heated to 97° C. and kept as such for 7 hours to fuse the aggregated particles. Thereafter, the mixture is cooled to 45° C. at a decreasing temperature of 1.0° C./min., filtered, sufficiently ished with deionized water, and filtered through a 400-mesh screen. The volume-average particle size of the fused particles, as determined with a Coulter counter, is 5.6 μm. These are dried in a vacuum drying oven to give toner particle C.

1.8 parts of colloidal silica (R972, produced by Nippon Aerogel Co., Ltd.) are added to 100 parts of the resulting toner particle C and mixed by a Henschel mixer to give color toner C.

The glass transition temperature of the resulting color toner C is 53.4° C. The tan δ is 0.19 at the glass transition temperature, and the tan δ at the temperature (81.2° C.) when G" is $1\times10^5$ Pa is 1.78. The maximum tan δ and minimum tan δ in the temperature range of from the glass transition temperature to the temperature at which G" is $1\times10^5$ Pa are 1.86 and 0.19, respectively.

The resulting color toner C previously weighed on a glass vessel is mixed for 5 minutes on a ball mill with ferrite carriers having a volume-average particle size of 50 μm coated with 1% polymethylmethacrylate (Soken Chemical & Engineering Co., Ltd.) such that the density of the toner relative to the ferrite carriers is 5% by mass, whereby developer (C) is obtained.

The resulting developer (C) is used to fix a fixed image in the same manner as in Example 1 and evaluated in the same manner as in Example 1. The results are shown in Table 1.

EXAMPLE 4

Resin dispersion (3): 300 parts
Colorant dispersion (1): 200 parts
Releasing agent dispersion (1): 110 parts
Rosin-modified maleic acid (softening point 140.3° C.): 135 parts (18.0% by mass)
Cationic surfactant (Sanizol B50, Kao Corporation): 3 parts
Deionized water: 500 parts The above components are mixed and dispersed with a homogenizer (Ultratarax T50, produced by IKA Co., Ltd.) in a round stainless steel flask, and then heated to 50° C. under stirring on a heating oil bath and kept at 52° C. for 40 minutes to form aggregated particles. When a part of the resulting aggregated particles are observed under an optical microscope, the volume-average particle size of the aggregated particles is about 5.4 μm. 80 parts of the resin dispersion (3) are added gently to this aggregated fluid and heated at 52° C. for 30 minutes under stirring, to give aggregated particle dispersion D. When the resulting aggregated particle dispersion D is observed under an optical microscope, the volume-average particle size of the aggregated particles is about 5.9 μm.

Then, 6 parts of an anionic surfactant sodium dodecylbenzenesulfonate (Neogen S C, produced by Daiichi Industries, Ltd.) are further added to the aggregated particle dispersion D, heated to 97° C., kept as such for 7 hours to fuse the aggregated particles. Thereafter, the mixture is cooled to 45° C. at a decreasing temperature of 1.0° C./min., filtered, sufficiently ished with deionized water, and filtered through a 400-mesh screen. The volume-average particle size of the fused particles, as determined with a Coulter counter, is 6.0 μm. These are dried in a vacuum drying oven to give toner particle D.

1.7 parts of colloidal silica (R972, produced by Nippon Aerogel Co., Ltd.) are added to 100 parts of the resulting toner particle D and mixed by a Henschel mixer to give color toner D.

The glass transition temperature of the resulting color toner D is 56.1° C. The tan δ is 0.15 at the glass transition temperature, and the tan δ at the temperature (86.4° C.) at which G" is $1\times10^5$ Pa is 1.87. The maximum tan δ and minimum tan δ in the temperature range of from the glass transition temperature to the temperature at which G" is $1\times10^5$ Pa are 1.99 and 0.15, respectively.

The resulting color toner D previously weighed on a glass vessel is mixed for 5 minutes on a ball mill with ferrite carriers having a volume-average particle size of 50 μm coated with 1% polymethyl methacrylate (Soken Chemical & Engineering Co., Ltd.) such that the density of the toner relative to the ferrite carriers is 5% by mass, whereby developer (D) is obtained.

The resulting developer (D) is used to fix a fixed image in the same manner as in Example 1 and evaluated in the same manner as in Example 1. The results are shown in Table 1.

Comparative Example 1

Toner particle E having a volume-average particle size of 5.6 μm is obtained by forming and fusing aggregated particles in the same manner as in Example 1 except that the rosin-modified maleic acid (softening point 139° C.) is not used. 2.0 parts of colloidal silica (R972, produced by Nippon Aerogel Co., Ltd.) are added to 100 parts of the resulting toner particle E and mixed by a Henschel mixer to give color toner E.

The glass transition temperature of the resulting color toner E is 51.4° C. The tan δ is 0.27 at the glass transition temperature, and the tan δ at the temperature (75.6° C.) when G" is $1\times10^5$ Pa is 2.56. The maximum tan δ and minimum tan δ in the temperature range of from the glass transition temperature to the temperature at which G" is $1\times10^5$ Pa are 2.77 and 0.27, respectively.

The resulting color toner E previously weighed on a glass vessel is mixed for 5 minutes on a ball mill with ferrite carriers having a volume-average particle size of 50 μm coated with 1% polymethylmethacrylate (Soken Chemical & Engineering Co., Ltd.) such that the density of the toner relative to the ferrite carriers is 5% by mass, whereby developer (E) is obtained.

The resulting developer (E) is used to fix a fixed image in the same manner as in Example 1 and evaluated in the same manner as in Example 1. The results are shown in Table 1.

Comparative Example 2

Toner particle F having a volume-average particle size of 5.8 μm is obtained by forming and fusing aggregated particles in the same manner as in Example 1 except that the amount of rosin-modified maleic acid (softening point 139° C.) is changed from 60 parts to 200 parts. 2.0 parts of colloidal silica (R972, produced by Nippon Aerogel Co., Ltd.) are added to 100 parts of the resulting toner particle F and mixed by a Henschel mixer to give color toner F.

The glass transition temperature of the resulting color toner F is 58.9° C. The tan δ is 0.21 at the glass transition temperature, and the tan δ at the temperature (86.6° C.) when G" is $1\times10^5$ Pa is 0.98. The maximum tan δ and minimum tan δ in the temperature range of from the glass transition temperature to the temperature at which G" is $1\times10^5$ Pa are 1.11 and 0.21, respectively.

The resulting color toner F previously weighed on a glass vessel is mixed for 5 minutes on a ball mill with ferrite carriers having a volume-average particle size of 50 μm coated with 1% polymethylmethacrylate (Soken Chemical & Engineering Co., Ltd.) such that the density of the toner relative to the ferrite carriers is 5% by mass, whereby developer (F) is obtained.

The resulting developer (F) is used to fix a fixed image in the same manner as in Example 1 and evaluated in the same manner as in Example 1. The results are shown in Table 1.

Comparative Example 3

Resin dispersion (4): 300 parts
Colorant dispersion (1): 200 parts
Releasing agent dispersion (1): 110 parts
Rosin-modified maleic acid (softening point 139° C.): 60 parts (9.2% by mass)
Cationic surfactant (Sanizol B50, Kao Corporation): 3 parts
Deionized water: 500 parts The above components are mixed and dispersed with a homogenizer (Ultratarax T50, produced by IKA Co., Ltd.) in a round stainless steel flask, and then heated to 53° C. under stirring on a heating oil bath and kept at 53° C. for 40 minutes to form aggregated particles. When a part of the resulting aggregated particles are observed under an optical microscope, the volume-average particle size of the aggregated particles is about 5.4 μm. 80 parts of the resin dispersion (4) are added gently to this aggregated fluid and heated at 53° C. for 30 minutes under stirring, to give aggregated particle dispersion G. When the resulting aggregated particle dispersion G is observed under an optical microscope, the volume-average particle size of the aggregated particles is about 5.7 μm.

Then, 6 parts of an anionic surfactant sodium dodecylbenzenesulfonate (Neogen SC, produced by Daiichi Industries, Ltd.) are further added to the aggregated dispersion G, heated to 97° C., kept as such for 7 hours to fuse the aggregated particles. Thereafter, the mixture is cooled to 45° C. at a decreasing temperature of 1.0° C./min., filtered, sufficiently ished with deionized water, and filtered through a 400-mesh screen. The volume-average particle size of the fused particles, as determined with a Coulter counter, is 5.6 μm. These are dried in a vacuum drying oven to give toner particle G. 2.0 parts of colloidal silica (R972, produced by Nippon Aerogel Co., Ltd.) are added to 100 parts of the resulting toner particle G and mixed by a Henschel mixer to give color toner G.

The glass transition temperature of the resulting color toner G is 58.1° C. The tan δ at the glass transition temperature is 0.20, and the tan δ at the temperature (89.4° C.) when G" is $1\times10^5$ Pa is 0.88. The maximum tan δ and minimum tan δ in the temperature range of from the glass transition temperature to the temperature at which G" is $1\times10^5$ Pa is 0.97 and 0.20, respectively.

The resulting color toner previously weighed on a glass vessel is mixed for 5 minutes on a ball mill with ferrite carriers having a volume-average particle size of 50 μm coated with 1% polymethylmethacrylate (Soken Chemical & Engineering Co., Ltd.) such that the density of the toner relative to the ferrite carriers is 5% by mass, whereby developer (G) is obtained.

The resulting developer (G) is used to fix a fixed image in the same manner as in Example 1 and evaluated in the same manner as in Example 1. The results are shown in Table 1.

Comparative Example 4

Toner particle H having a volume-average particle size of 5.7 μm is obtained by forming and fusing aggregated particles in the same manner as in Example 1 except that the resin dispersion (5) is used in place of the resin dispersion (1), and rosin-modified maleic acid (softening point 140° C.) is used in place of the rosin-modified maleic acid (softening point 139° C.). 2.0 parts of colloidal silica (R972, produced by Nippon Aerogel Co., Ltd.) are added to 100 parts of the resulting toner particle H and mixed by a Henschel mixer to give color toner H.

The glass transition temperature of the resulting color toner H is 74.6° C. The tan at the glass transition temperature is 0.27, and the tan δ at the temperature (120.3° C.) when G" is $1\times10^5$ Pa is 1.22. The maximum tan δ and minimum tan δ in the temperature range of from the glass transition temperature to the temperature at which G" is 1×105 Pa are 1.46 and 0.27, respectively.

The resulting color toner H previously weighed on a glass vessel is mixed for 5 minutes on a ball mill with ferrite carriers having a volume-average particle size of 50 μm coated with 1% polymethylmethacrylate (Soken Chemical & Engineering Co., Ltd.) such that the density of the toner relative to the ferrite carriers is 5% by mass, whereby developer (H) is obtained.

The resulting developer (H) is used to fix a fixed image in the same manner as in Example 1 and evaluated in the same manner as in Example 1. The results are shown in Table 1.

Comparative Example 5

Toner particle I having a volume-average particle size of 5.7 μm is obtained by forming and fusing aggregated particles in the same manner as in Example 1 except that the resin dispersion (6) is used in place of the resin dispersion (1), and rosin-modified maleic acid (softening point 140° C.) is used in place of the rosin-modified maleic acid (softening point 139° C.). 2.0 parts of colloidal silica (R972, produced by Nippon Aerogel Co., Ltd.) are added to 100 parts of the resulting toner particle I and mixed by a Henschel mixer to give color toner I.

The glass transition temperature of the resulting color toner I is 45.3° C. The tan at the glass transition temperature is 0.16, and the tan δ at the temperature (66.7° C.) when G" is $1\times10^5$ Pa is 2.61. The maximum tan δ and minimum tan δ in the temperature range of from the glass transition temperature to the temperature at which G" is $1\times10^5$ Pa are 2.73 and 0.16, respectively.

The resulting color toner H [sic] previously weighed on a glass vessel is mixed for 5 minutes on a ball mill with ferrite carriers having a volume-average particle size of 50 μm coated with 1% polymethyl methacrylate (Soken Chemical & Engineering Co., Ltd.) such that the density of the toner relative to the ferrite carriers is 5% by mass, where by developer (I) is obtained.

The resulting developer (I) is used to fix a fixed image in the same manner as in Example 1 and evaluated in the same manner as in Example 1. The results are shown in Table 1.

According to the invention, there can be provided a color toner which can give a highly gloss image and give a document excellent in storage for a long time.

What is claimed is:

1. A color toner comprising a binder resin and a colorant, wherein

A) the weight average molecular weight of the binder resin is in the range of from 6000 to 45000;

B) the glass transition temperature (Tg) of the toner is in the range of from 40 to 70° C.;

C) the loss tangent tan δ of dynamic viscoelasticity of the toner is in the range of from 0.1 to 2.5 in the temperature range of from the glass transition temperature (Tg) of the toner to the temperature at which the loss modulus (G") is $1\times10^5$ Pa;

D) the toner comprises 3 to 20% by mass of at least one compound selected from the group consisting of a rosin-modified maleic acid and a styrene-maleic acid; and E) the molecular weight distribution of the binder resin, represented by Mw/Mn, which is the ratio of weight average molecular weight Mw to number average molecular weight Mn, is no more than 3.3.

2. A color toner according to claim 1, wherein the softening point of the at least one compound selected from the group consisting of a rosin-modified maleic acid and a styrene-maleic acid is 135 to 160° C.

3. A color toner according to claim 1, further comprising a releasing agent.

4. A color toner according to claim 1, wherein the volume-average particle size of the color toner is in the range of from 3 to 8 μm.

5. A color toner according to claim 1, wherein the binder resin is a vinyl resin.

6. A color toner according to claim 5, wherein the vinyl resin is a polymer of vinyl carboxylic acid.

7. A color toner according to claim 1, wherein the binder resin is a polyester resin having a weight average molecular weight of 6000 to 10000.

TABLE 1

| | Compound in the invention | | Binder resin | | Glass transition point | | When G" becames $1\times10^5$ Pa | | tan δ* | | | | |
|---|---|---|---|---|---|---|---|---|---|---|---|---|---|
| | amount (%) | softening point (° C.) | Mw | Mw/Mn | tempera-ture (° C.) | tan δ | tempera-ture (° C.) | tan δ | maximum value | minimum value | Gloss after fixation | Bending test | Storage test |
| Example 1 | 9.2 | 139 | 24000 | 2.4 | 52.8 | 0.22 | 78.6 | 1.76 | 1.88 | 0.22 | 78.2○ | ○ | ○ |
| Example 2 | 12.8 | 148 | 22000 | 2.7 | 51.6 | 0.18 | 77.3 | 1.55 | 1.60 | 0.18 | 80.4○ | ○ | ○ |
| Example 3 | 6.1 | 155 | 24000 | 2.4 | 53.4 | 0.19 | 81.2 | 1.78 | 1.86 | 0.19 | 77.1○ | ○ | ○ |
| Example 4 | 18.0 | 140 | 36000 | 2.8 | 56.1 | 0.15 | 86.4 | 1.87 | 1.99 | 0.15 | 74.6○ | ○ | ○ |
| Comparative Example 1 | — | — | 24000 | 2.4 | 51.4 | 0.27 | 75.6 | 2.56 | 2.77 | 0.27 | 80.1○ | X | X |
| Comparative Example 2 | 25.0 | 139 | 24000 | 2.4 | 58.9 | 0.21 | 86.6 | 0.98 | 1.11 | 0.21 | 69.6X | X | X |
| Comparative Example 3 | 9.2 | 139 | 48000 | 3.7 | 58.1 | 0.20 | 89.4 | 0.88 | 0.97 | 0.20 | 43.9X | ○ | X |
| Comparative Example 4 | 9.2 | 140 | 30000 | 5.2 | 74.6 | 0.27 | 120.3 | 1.22 | 1.46 | 0.27 | 23.2X | X | ○ |
| Comparative Example 5 | 9.2 | 140 | 18000 | 2.4 | 45.3 | 0.16 | 66.7 | 2.61 | 2.73 | 0.16 | 83.3X | ○ | X |

*The maximum and minimum values in the table show the maximum and minimum values in the range of from the glass transition point to the temperature at which G" is $1\times10^5$ Pa.

Table 1 shows that the fixed images using the color toner have high gloss, excellent image strength and excellent storage ability.

8. A color toner according to claim 1, wherein the binder resin is a vinyl resin having a weight average molecular weight of 24000 to 36000.

9. A color toner according to claim 1, wherein the glass transition temperature (Tg) of the toner is in the range of from 45 to 60° C.

10. A color toner according to claim 1, wherein the volume-average particle size of the colorant is no more than 1 μm.

11. A color toner according to claim 11, wherein the volume-average particle size of the colorant is from 0.01 to 0.5 μm.

12. A color toner according to claim 1, wherein the difference between the solubility parameter of the binder resin and the solubility parameter of the at least one compound selected from the group consisting of a rosin-modified maleic acid and a styrene-maleic acid is no more than 4.

13. A color toner according to claim 1, wherein the difference between the solubility parameter of the binder resin and the solubility parameter of the at least one compound selected from the group consisting of a rosin-modified maleic acid and a styrene-maleic acid is no more than 2.8.

14. A color toner according to claim 1, wherein the content of the at least one compound selected from the group consisting of a rosin-modified maleic acid and a styrene-maleic acid is 3 to 15% by mass.

15. A color toner according to claim 1, wherein the content of the at least one compound selected from the group consisting of a rosin-modified maleic acid and a styrene-maleic acid is 5 to 10% by mass.

16. An electrostatic latent image developer comprising the toner of claim 1 and a carrier including a resin coating layer.

17. A color toner according to claim 1, wherein the molecular weight distribution of the binder resin, represented by Mw/Mn, which is the ratio of weight average molecular weight Mw to number average molecular weight Mn, is 2.8 or less.

18. A color toner according to claim 1, wherein the toner comprises 6.1 to 20% by mass of the at least one compound selected from the group consisting of a rosin-modified maleic acid and a styrene-maleic acid.

19. A color toner according to claim 1, wherein the toner comprises 5 to 20% by mass of the at least one compound selected from the group consisting of a rosin-modified maleic acid and a styrene-maleic acid.

20. A color toner according to claim 1, wherein the toner comprises 5 to 15% by mass of the at least one compound selected from the group consisting of a rosin-modified maleic acid and a styrene-maleic acid.

21. An image forming method comprising the steps of: forming an electrostatic latent image on an image holding member in accordance with image information; visualizing the electrostatic latent image as a toner image using a developer; transferring the toner image onto a transfer material; and fixing the transfer material, to which the toner image is transferred, wherein the developer includes the toner of claim 1.

* * * * *